US007937868B2

(12) United States Patent
Gallet

(10) Patent No.: US 7,937,868 B2
(45) Date of Patent: May 10, 2011

(54) DAY/NIGHT SAFETY SIGN USING REFLECTIVE INTERNAL LIGHTING

(76) Inventor: Ray Gallet, Lemont, IL (US)

( * ) Notice: Subject to any disclaimer, the term of this patent is extended or adjusted under 35 U.S.C. 154(b) by 0 days.

(21) Appl. No.: 11/823,586

(22) Filed: Jun. 28, 2007

(65) Prior Publication Data

US 2009/0000166 A1 Jan. 1, 2009

(51) Int. Cl.
*G09F 13/00* (2006.01)

(52) U.S. Cl. ..... 40/612; 40/443; 40/582

(58) Field of Classification Search ..... 40/580, 40/564, 570, 586
See application file for complete search history.

(56) References Cited

U.S. PATENT DOCUMENTS

| | | | | | |
|---|---|---|---|---|---|
| 1,118,866 | A * | 11/1914 | Jones | 40/572 |
| 1,792,635 | A * | 2/1931 | Gropper | 40/205 |
| 2,089,804 | A * | 8/1937 | Laws | 40/577 |
| 2,216,424 | A * | 10/1940 | Stehlin | 40/580 |
| 3,324,290 | A * | 6/1967 | Lasker | 40/563 |
| 3,921,324 | A * | 11/1975 | Flannery | 362/497 |
| 5,151,679 | A * | 9/1992 | Dimmick | 340/326 |
| 5,365,411 | A * | 11/1994 | Rycroft et al. | 362/20 |
| 5,428,912 | A * | 7/1995 | Grondal et al. | 40/570 |
| 5,566,484 | A * | 10/1996 | Wachter | 40/570 |
| 6,401,373 | B1 * | 6/2002 | Sexton | 40/576 |
| 6,409,358 | B1 | 6/2002 | Grover | 362/109 |
| 6,693,556 | B1 | 2/2004 | Jones et al. | 340/907 |
| 6,943,698 | B2 | 9/2005 | Jones et al. | 340/7 |
| 7,114,804 | B2 * | 10/2006 | Nunokawa | 347/104 |
| 2004/0183694 | A1 * | 9/2004 | Bauer | 340/907 |

OTHER PUBLICATIONS

Solar Powered Signs, www.nwpr.com.

* cited by examiner

*Primary Examiner* — Cassandra Davis
(74) *Attorney, Agent, or Firm* — Clifford Kraft

(57) ABSTRACT

A safety sign that has a front panel with cut out letters or numbers that form the word or message of the sign. Behind the front panel a predetermined distance can be a reflective panel or other surface. Light from an oncoming vehicle can reflect from this reflective panel through the cut out letters causing the sign to function like any other safety sign when not lighted. One or more light sources like LEDs can be mounted facing the reflective panel at angles so that light from these sources is reflected from the reflective panel and out through the cut out letters causing the sign to increase significantly in visibility at night or in other low light conditions. Further light sources can be located around the periphery of the sign or around the word or words on the sign. All or part of the light sources can be made to blink, and the system can optionally be made to turn off during the daytime. The sign can be run from AC power or battery power. An optional solar panel can charge the battery during the daytime.

2 Claims, 5 Drawing Sheets

DAY/NIGHT SAFETY SIGN USING REFLECTIVE INTERNAL LIGHTING

BACKGROUND

1. Field of the Invention

The present invention relates generally to day/night safety signs such as stop signs and more particularly to a day/night safety sign that uses reflective internal lighting.

2. Description of the Prior Art

Stop signs and other safety signs with reflective paint or reflective letters are well known in the art. In addition, solar and otherwise powered, lighted signs are common. Many signs are powered by AC power or by batteries. Some signs are hand-held such as the sign taught by U.S. Pat. No. 6,409,358 that uses a flashlight to internally illuminate it.

The disadvantage of prior art lighted signs is that many are not visible at night if the lighting fails. Attempts to put reflective surface on the letters fails if they also have to be translucent to allow internal lighting to penetrate at night. It would be advantageous to have a solar-powered, lighted sign that functions and looks exactly like a normal sign day or night without power; however, that can be brightly lighted at night. Such a sign could use internal lighting that is reflected from a highly reflecting surface behind the letters.

SUMMARY OF THE INVENTION

The present invention relates to safety signs that have a front panel with cut out or open letters or numbers that form the words or message of the sign. For example, a stop sign could have a red front panel with cut out letters forming the word STOP. A predetermined distance behind the front panel there can be a reflective panel or other surface generally parallel with the front panel. Light from an oncoming vehicle can reflect from this reflective panel through the cut out letters causing the sign to function like any other safety sign when not lighted. One or more (preferably 4 to 8) light sources like LEDs can be mounted facing the reflective panel at angles so that light from these sources is reflected from the reflective panel and back out through the cut out letters. This causes the sign to increase significantly in visibility at night or in other low light conditions. On a stop sign, these light sources are preferably white. Further light sources can be located around the periphery of the sign or around the word or words on the sign. On a stop sign, these additional light sources would be preferably red. All or part of the light sources can be made to blink, and the system can be made to turn off during the daytime. The sign can be run from AC power or can be run from battery power. An optional solar panel can charge the battery during the daytime.

DESCRIPTION OF THE DRAWINGS

The following illustrations are presented to better explain the present invention.

Several illustrations and drawings have been presented to better aid in understanding the present invention. The scope of the present invention is not limited to what is shown in the figures.

DESCRIPTION OF THE INVENTION

The present invention relates to lighted signs using reflective internal lighting. The general principle of the invention is to use cutout or open letters in a front plate with a highly reflective strip or plate mounted a distance behind the letters. A series of light sources, usually LEDs, can be mounted above this reflective strip plate but under the front plate and off to the side. Light from the light sources can then be used to illuminate the reflective plate from the front so that the light reflects off the reflective plate and thence through the cutout letters in the front plate.

Figure 1:
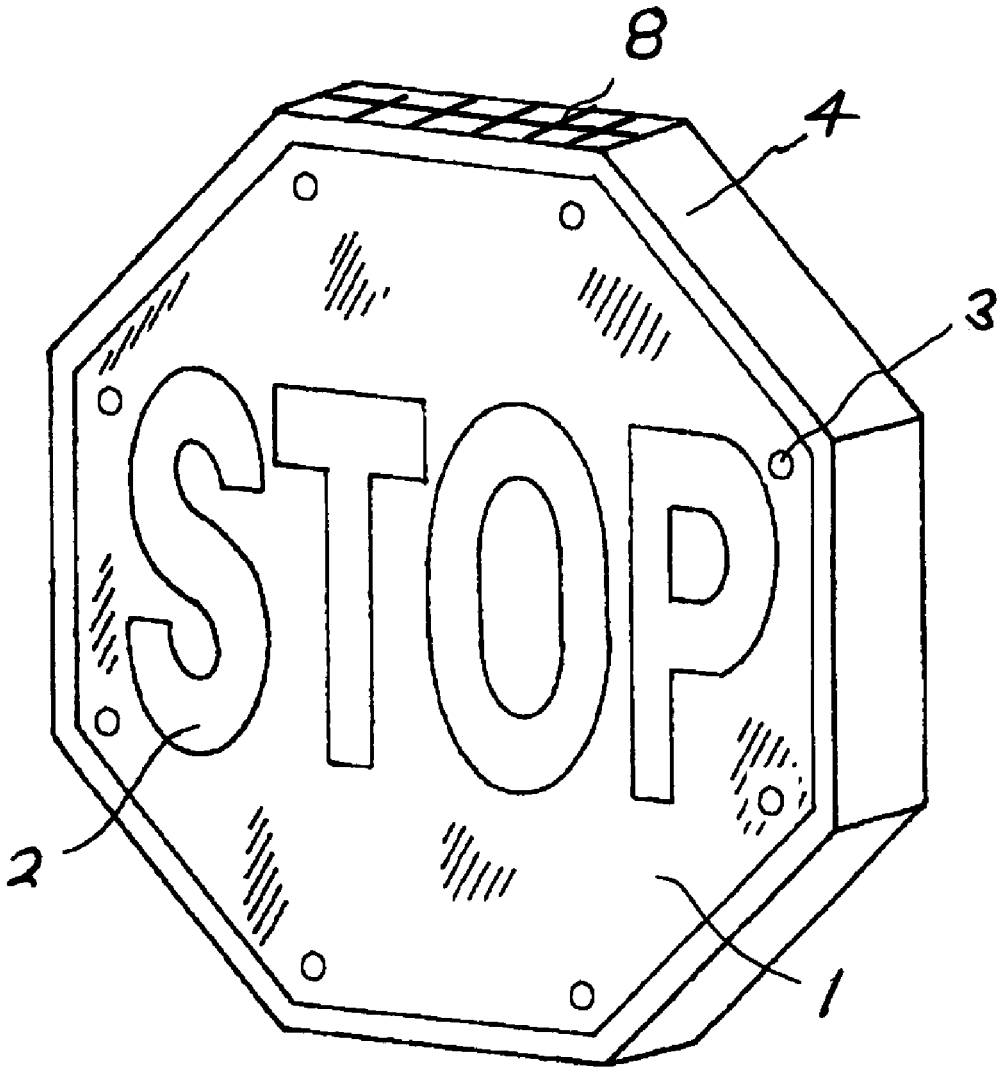
FIG. 1 shows a perspective view of a stop sign embodiment of the present invention

Turning to FIG. 1, a perspective view of an embodiment of the present invention can be seen, in this case, a stop sign. The sign has a frame 4 and a front plate 1 with open or cut-out letters 2. Several optional lights 3, preferably red LEDs, surround the center letters of the sign. An optional solar panel 8 can be mounted on the sign as shown in FIG. 1 or can be located separately.

Figure 2:
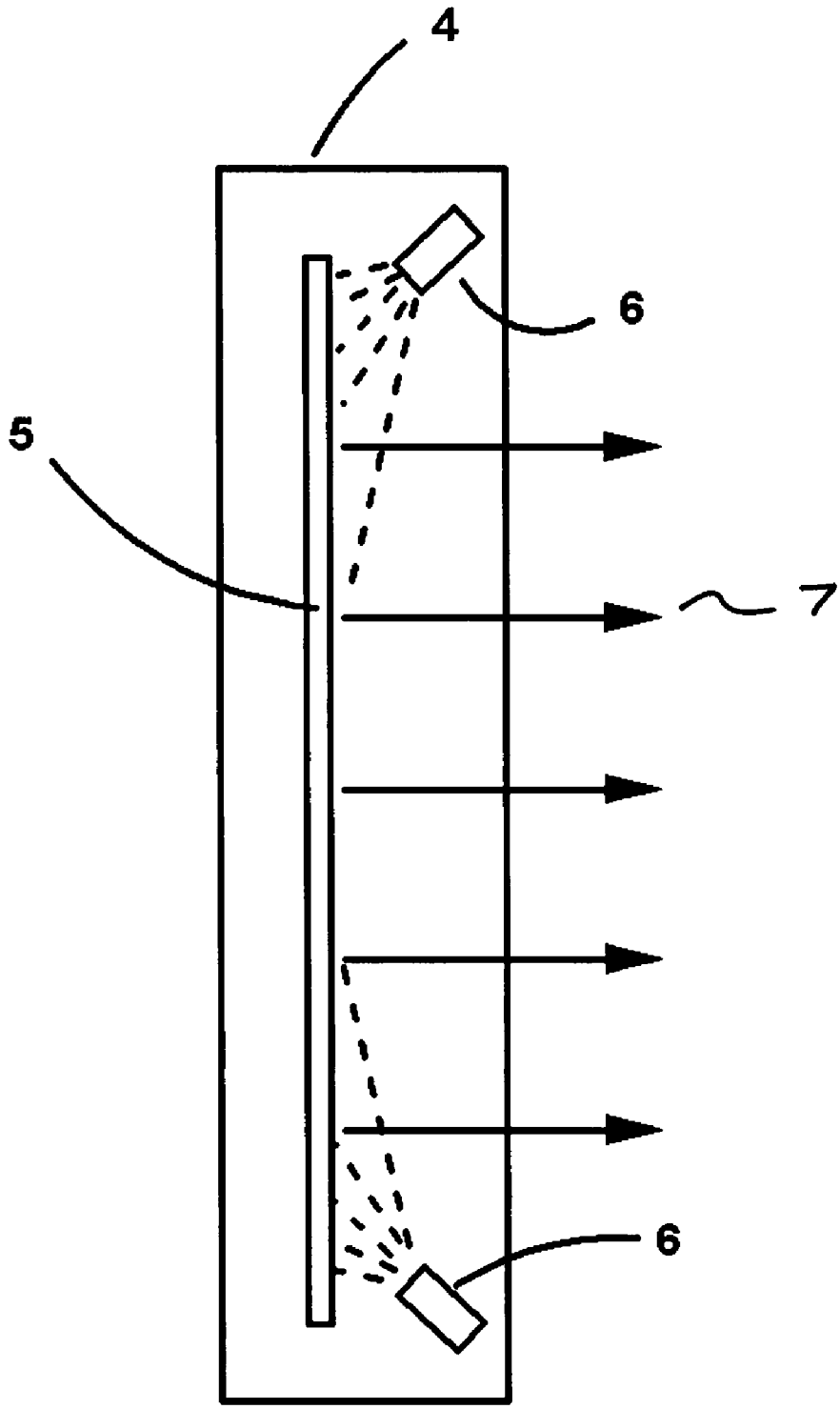
FIG. 2 is a sectional side view showing the reflective principle.
Figure 3:
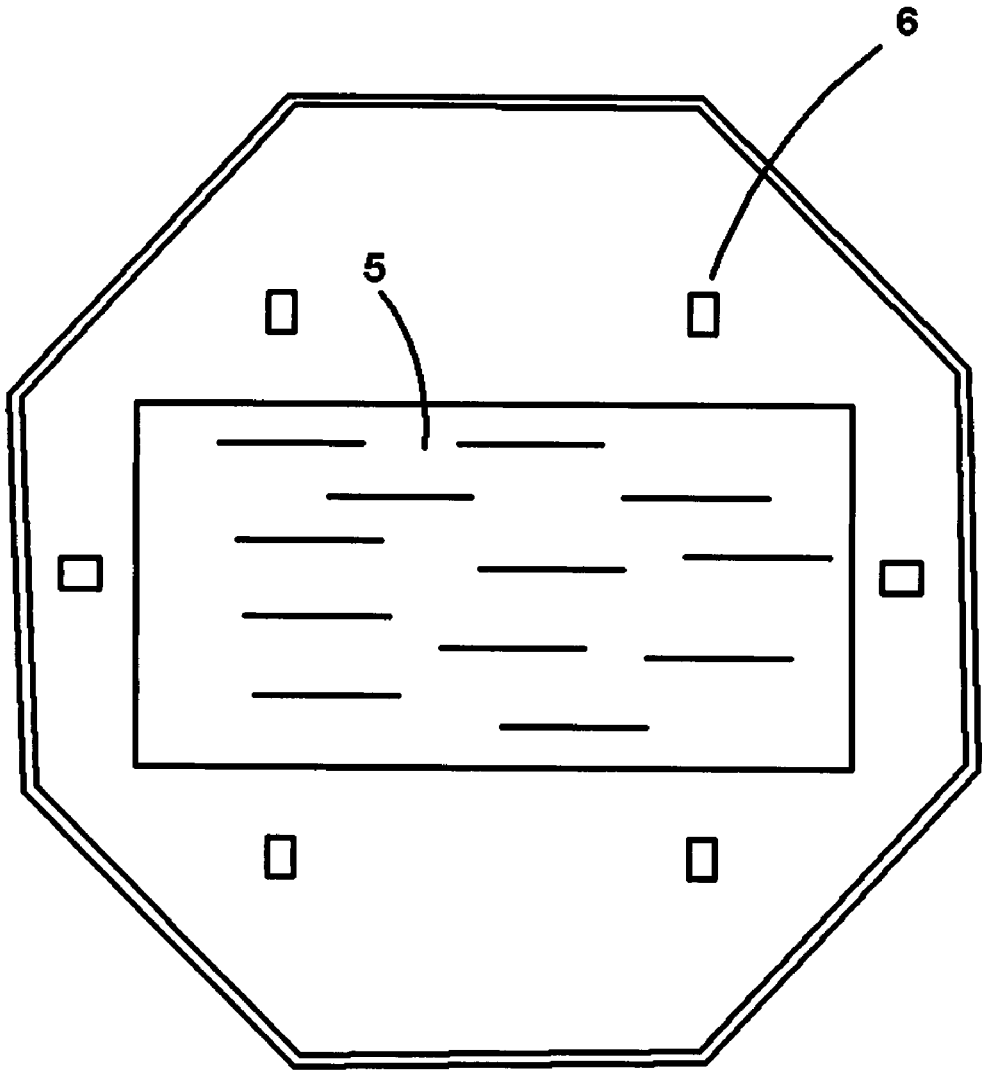
FIG. 3 is a front view of the reflective surface with the top of the sign removed.

FIG. 2 shows an embodiment of the light reflective principle of the present invention. Several (at least one) light sources 6, preferably white LEDs, cause light to be directed onto a reflective plate 5 from where it scatters toward the front of the sign. The preferred angle of these light sources is around 45 degrees with respect to the surface of the reflective plate 5. The scattered light 7 exits the front plate 1 (FIG. 1) through cut out letters 2 (FIG. 1). The reflective principle of the present invention is also illustrated in FIG. 3. Again, one or more light sources or LEDs 6 are directed onto one or more reflective plates 5. The preferred surface of the reflective plate is high intensity sheeting manufactured by 3M Corporation of Minnesota. While this is the preferred material, any highly reflective material can be used. The reflective plate or other surface can be located a predetermined distance behind the face plate. The preferred distance is from around ½ to around 6 or more inches.

The reflective principle used in the present invention distinguishes it from other lighted signs in that if there is a case where somehow power fails, or the lighting does not work, the sign reverts to a normal reflective sign. The reflective plate or strip behind the cutout letters acts exactly as the reflective letters on any safety sign. In a failure mode, at night a vehicle's lights will reflect off the reflective plate exactly as off of any sign, for example a stop sign. Since the reflective strip can only be seen through the cutout letters, an approaching driver sees only the letters reflecting. Again, in the daytime, an approaching driver sees the reflective plate behind the letters and hence sees the letters exactly as with any other sign. However, when the sign is lighted, the light reflected from the internal light sources 6 off of the reflective plate 5 and out through the front of the sign and the cutout letters cause the sign to become considerably more visible. Attention and contrast is also caused by the colored light sources on the front plate of the sign that ring the sign.

The signs of the present invention can be made to blink. The recommended blink rate is around 55-60 times a minute. In the United States, all safety signs used with roadways must meet DOT standards. These standards specify intensity and blink rate of lighted signs as well as sizes and materials for all road safety signs. In particular, to meet these standards in the U.S., the sign should be made from 0.064 to 0.080 inch thickness aluminum. Stop signs must be red octagons with particularly sized white reflecting letters. The signs of the present invention can be made to meet any specification including those of DOT or any international standard.

Figure 4:
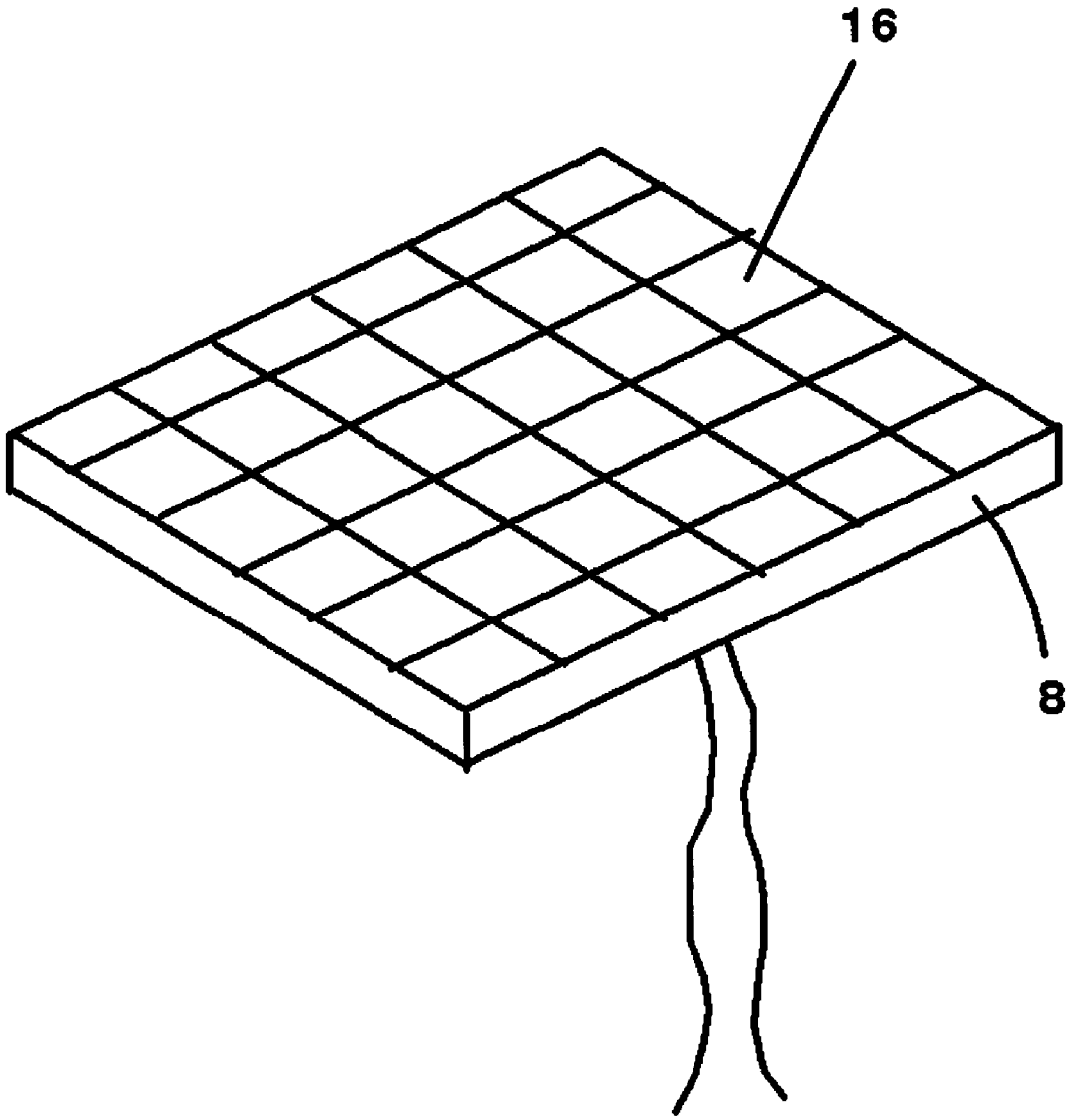
FIG. 4 shows a solar panel that can be used with the present invention.

The signs of the present invention can use an optional solar panel 8 with solar cells 16 shown in FIG. 4. The solar panel 8 can be mounted on top of the sign as shown in FIG. 1 or can be located on the top of a pole (where the sign is also mounted) or otherwise remotely located from the sign. It has been found that a 12 watt solar panel (normal sunlight) and be used with a 6 volt battery to power the sign. While this is preferred wattage and voltage, any other convenient wattage and voltage can be used.

Figure 5:
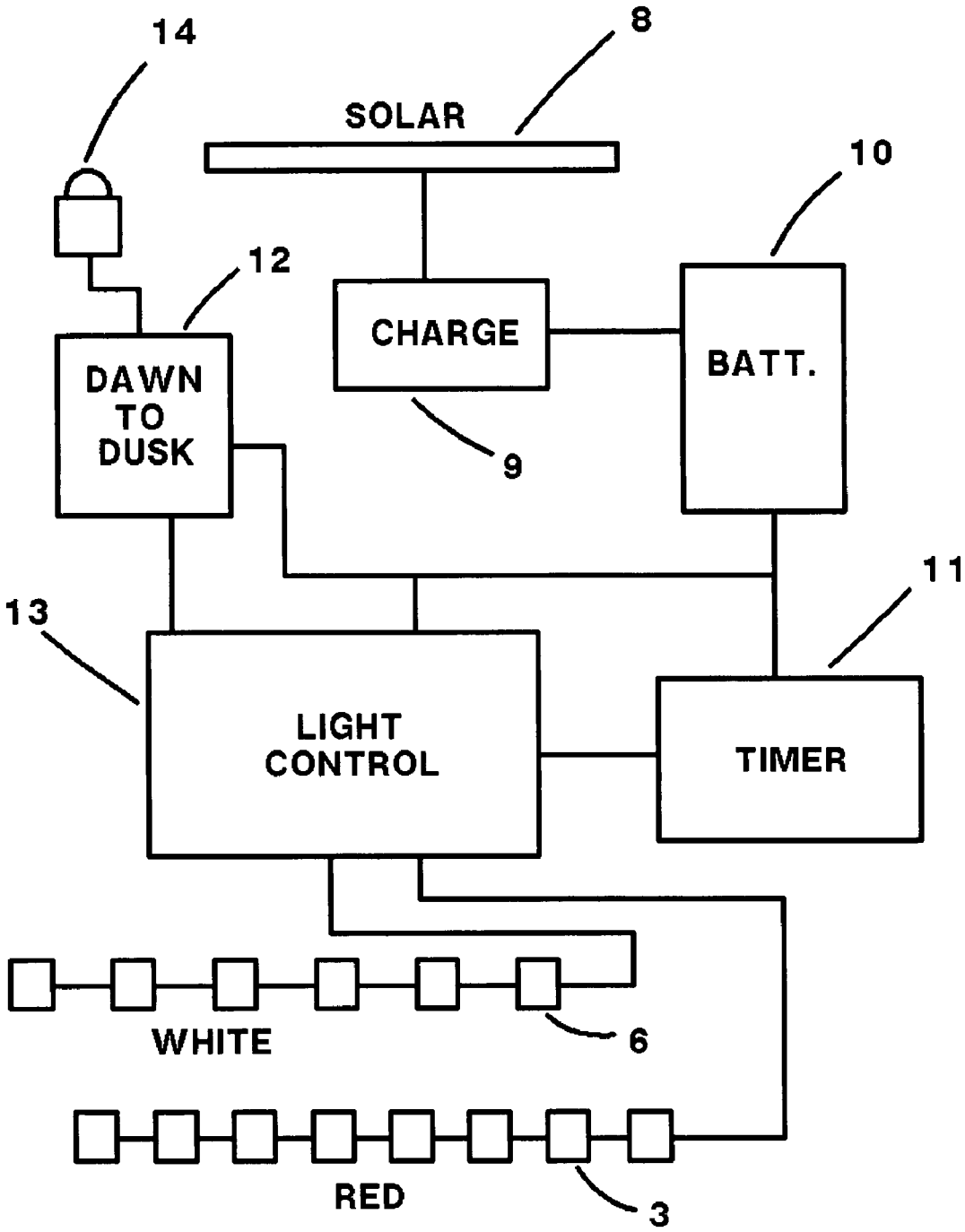
FIG. 5 is a block diagram of the electrical circuit of an embodiment of the present invention.

FIG. 5 shows a block schematic diagram of an embodiment of the present invention. An optional solar panel 8 charges the battery 10 though an optional charging control circuit 9. With some solar panels, direct connection to the battery 10 is possible. The battery is chosen so that it can last through several nights without having been charged. The battery/solar panel combination should be such that one day of sunlight charges the battery sufficiently for at least two or more nights of operation. A particular circuit 12 can be attached to the solar panel 8 or charger 9 to detect night and day. This can be done with a separate photo detector 14 or by sensing light on the solar array 8. Normally, the sign will not be lighted during the daytime unless ambient light is severely reduced (such as during storms, fog, solar eclipses and the like). It is optionally possible with some embodiments of the present invention to adjust the ambient light level where the sign lights. While it is preferred to not power the sign in bright sunlight (to save battery for example), the sign can be optionally designed in some embodiments to stay continuously on. In alternate embodiments, the amount of on and off times can be adjusted, or the sign can be turned on and off at particular clock times. While using clock times is within the scope of the invention, it is preferable to turn the sign on and off based on the intensity of ambient light.

The sign can be made to blink with a timer 11 that controls a light control circuit 13. The light control circuit 13 draws current from the battery 10 and uses it to light the lights 3, 6. The optional periphery lights 6 can be the same color as the background of the front plate (red for a stop sign, yellow for a caution sign), while the source lights 3 for reflection through the letters are normally white. While white is preferred, any color is within the scope of the present invention. Different colors may be preferred or required by various standards in various countries.

Both the periphery lights 6 and the main source lights 3 can be made to blink; however, in some embodiments of the present invention, only one or the other of these groups blinks. Maximum attention is drawn to the sign when all of the lights blink.

Since the signs of the present invention will be found along public roadways and streets, possibly remote from supervision, it is possible and desirable to provide optional locking and anti-theft features known in the art such as difficulty opening the sign and remote status reporting and/or alarming or a local alarm that sounds on any major attempt to open or disturb the sign.

Several descriptions and illustrations have been provided to aid in understanding the present invention. One skilled in the art will understand that numerous changes and variations are possible without departing from the spirit of the invention. Each of these changes and variations is within the scope of the present invention.

I claim:

1. A lighted octagon stop sign comprising:

a rigid frame supporting a front panel with cut out letters spelling the word stop;

a reflective surface located a predetermined distance behind said front panel;

at least one white directed light source located behind said front panel and in front of said reflective surface, wherein said light source directs light onto said reflective panel, whereby light from said light source reflects from said reflective panel and exits said sign through said cutout letters;

a plurality of non-reflected red light sources mounted at the periphery of said front panel;

wherein said white and red light sources blink when lighted, and said white and red light sources turn off in daylight of predetermined brightness;

a solar panel charging a battery in daylight, said battery providing power for said white and red light sources.

2. The safety sign of claim 1 wherein said directed light source is an LED.

* * * * *